United States Patent [19]

Lerner et al.

[11] 4,089,756

[45] May 16, 1978

[54] HARD ANODIZING PROCESS

[75] Inventors: Moisey M. Lerner, Brighton; James H. Morse, Holliston, both of Mass.

[73] Assignee: Sanford Process Corporation, Natick, Mass.

[21] Appl. No.: 707,691

[22] Filed: Jul. 22, 1976

[51] Int. Cl.[2] ..... C25D 11/02; C25D 11/04; C25D 11/12

[52] U.S. Cl. ..... 204/58; 204/205; 204/228

[58] Field of Search ..... 204/58, 228, 198, 204, 204/205, 211, 56

[56] References Cited

U.S. PATENT DOCUMENTS

| | | | |
|---|---|---|---|
| 2,920,018 | 1/1960 | Miller | 204/56 R |
| 3,391,073 | 7/1968 | Rusch et al. | 204/198 |
| 3,597,339 | 8/1971 | Newman et al. | 204/228 |
| 3,745,100 | 7/1973 | Lasser | 204/58 |
| 3,827,951 | 8/1974 | Kallianides et al. | 204/58 |

*Primary Examiner*—T. M. Tufariello
*Attorney, Agent, or Firm*—Weingarten, Maxham & Schurgin

[57] ABSTRACT

A method and system for anodizing and particularly for hard anodizing of aluminum and aluminum alloy articles in which a wide range of operating voltages can be employed without danger to personnel and without burning of the articles. For continuous (dynamic) processing, a plurality of electrolyte-containing tanks are employed with an associated cooling system for maintaining the electrolyte at a low operating temperature. Each tank, cathode, electrolyte and cooling apparatus are electrically insulated from ground, while each cathode, which can be the tank itself, is connected to a predetermined negative potential of a power source which source comprises one or more separate power supplies. A conductive conveyor system is provided to carry articles through the several tanks and is connected to ground to which is also connected a positive terminal or terminals of the power source. For batch (static) anodizing, a single electrolyte-containing tank is employed with an associated cooling system, the tank, cathode, electrolyte and cooling system being isolated from electrical ground, with the articles to be anodized being grounded. A negative terminal of a power supply is connected to the cathode, which can be the tank itself, while a positive terminal of the power supply is connected to ground.

6 Claims, 2 Drawing Figures

HARD ANODIZING PROCESS

FIELD OF THE INVENTION

This invention relates to the anodizing of aluminum and aluminum alloys and more particularly to a method and system for anodizing and hard anodizing.

BACKGROUND OF THE INVENTION

Anodizing of aluminum and aluminum alloys is accomplished by immersing articles to be anodized in an electrolyte, with the articles being connected to the positive terminal of a power source and with the cathode electrode, which can be one or more electrode elements or the tank itself, being connected to the negative terminal of the power source. Anodizing may be accomplished in a batch (static) system in which articles are statically disposed in the electrolyte, or in a continuous (dynamic) system in which articles are moved into successive tanks of electrolyte, with continual replenishing and progression of articles in and out of the tanks.

The properties of the oxide film obtained by anodizing of aluminum and aluminum alloys depend on the type of electrolyte employed. Anodizing in water solutions of weak acids, such as boric acid, citric acid, etc., and often referred to as barrier layer anodizing, provides thin (up to one micron) homogeneous oxide films with good dielectric properties. The term weak acid refers to an acid which does not appreciably dissolve the oxide film. Anodizing in water solutions of strong acids, that is, electrolytes which are capable of appreciably dissolving the oxide film, such as sulfuric acid, chromic acid, oxalic acid, etc. provides a thick (from several up to hundreds of microns) porous oxide film with decorative, corrosion and chemical resistant and other intended properties.

A major distinction between anodizing in strong electrolytes and anodizing in weak electrolytes is the necessity, when using strong electrolytes, of cooling the electrolyte to a low operating temperature typically in the range of 0° to 24° C. The cooling apparatus usually includes cooling coils immersed in the electrolyte and electrically grounds the electrolyte. Barrier layer anodizing is usually accomplished at a relatively high temperature, typically near 100° C., and does not ordinarily require any cooling.

For the provision of relatively thick, hard, wear-and-corrosion-resistant aluminum oxide film on the surfaces of aluminum and alloys thereof a process of hard anodizing or hard coating is employed in which a strong electrolyte is maintained at a relatively low operating temperature and relatively high voltages employed to achieve the intended oxide coating. Such hard anodizing techniques are described, for example, in U.S. Pat. Nos. 2,743,221; 2,855,350; 2,987,125; 2,905,600 and 2,977,294 of the present assignee. For hard anodizing, the potential can be up to 70 V or higher which presents a shock hazard to personnel when handling articles without turning off the voltage. Such handling often occurs when articles are simultaneously run in a tank and removed after different anodizing times to achieve different coating thicknesses and also when loading or unloading endless conductive conveyor belts. At higher voltages, the anodizing process becomes more vigorous, leading to burning of articles entering the electrolyte at such higher voltages. For hard coating, a voltage of up to 70 VDC or more must be applied to the articles at the end of the process and this voltage will inevitably lead to burning if the process is started with this high voltage. Step anodizing in a succession of tanks with a step rise in voltage in each tank is not possible, if, as in conventional systems, the electrolyte in the tanks is grounded and thus has the same zero potential and if the conveyor carrying articles through the tank is conductive and therefore is at another single potential.

SUMMARY OF THE INVENTION

In brief, the present invention provides a method and system for anodizing and particularly for the hard anodizing of articles in which a wide range of operating voltages can be employed without shock hazard to personnel and without burning of the articles. According to the invention the articles to be anodized are grounded and electrolyte, cathode and cooling system in the tank are isolated from ground. As employed in continuous processing, a conductive conveyor is grounded, as are the articles to be processed and which are carried by the conveyor. The positive terminal of a power source is connected to ground. The cathodes of the tanks, which may be the tanks themselves, are each connected to the same or different negative terminals of the power source. As a result, the most accessible portions of the apparatus, namely the conveyor and items being processed, are at ground potential thereby greatly improving the safety of the system. The tanks and/or their cathode systems being isolated from ground, can be readily connected to different negative potentials in accordance with an intended processing sequence. The tanks and/or cathode systems are usually shielded to prevent easy access by personnel to minimize shock hazard. Step continuous processes are easily achieved by virtue of the tanks and/or their cathode systems being capable of electrical connection to different negative potentials. The cooling or refrigerating apparatus employed to maintain the electrolyte at a low operating temperature is insulated from ground to prevent electrical connection of the electrolyte of the multiple tanks. Such insulation is provided by employing non-conductive cooling coils within the tanks or by employing non-conductive pipe sections in the coolant piping such that the electrolyte in the multiple tanks remain electrically isolated from ground. In the event that a conductive coolant is employed, the piping which interconnects the tanks is of sufficient lenth and/or cross-section to yield an intended resistance to prevent excess current leakage.

As employed in a batch process, a single electrolyte-containing tank is employed with an associated cooling system, the tank, cathode, electrolyte and cooling system being isolated from electrical ground, and with the articles to be anodized being grounded. A negative terminal of a power source is connected to the tank and/or cathode system, while a positive terminal of the power source is connected to ground.

DESCRIPTION OF THE DRAWINGS

The invention will be more fully understood from the following detailed description taken in conjunction with the drawings in which.

DETAILED DESCRIPTION OF THE INVENTION

Figure 1:
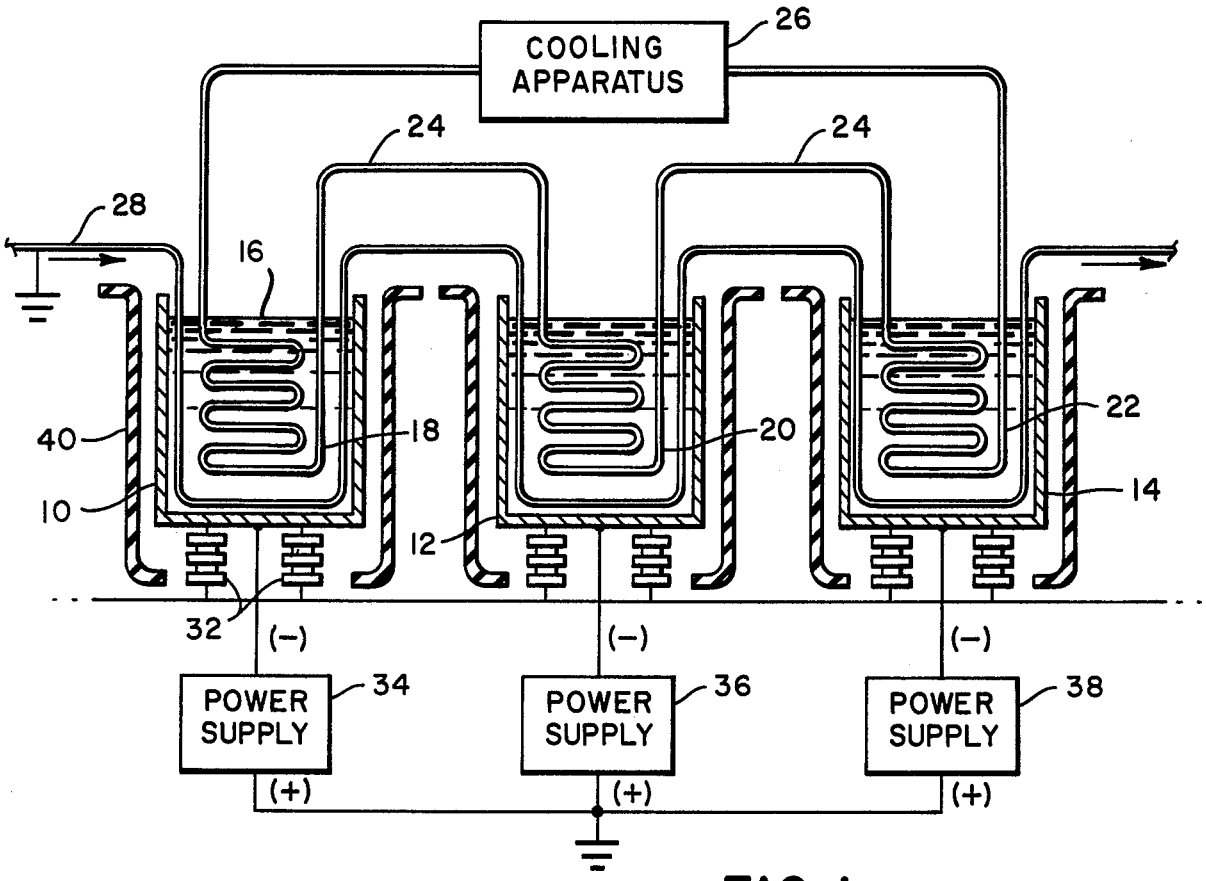
FIG. 1 is a diagramatic representation of a continuous (dynamic) hard anodizing system according to the invention.

Referring to FIG. 1, there is shown a system for the continuous hard anodizing of articles, including a plurality of electrically conductive tanks, 10, 12 and 14 each containing a strong electrolyte 16 of a composition suitable for the purposes of the particular anodizing process. Within each tank is disposed a respective cooling coil 18, 20 and 22, these coils being interconnected by piping 24 and being coupled to cooling or refrigerating apparatus 26. The cooling system causes the flow of a coolant through coils 18, 20 and 22 to maintain the electrolyte in the tanks 10, 12 and 14 at intended low operating temperature, typically in the temperature range of 0° to 24° C. A conveyor 28 of electrically conductive material is arranged for movement through the several tanks for the transport of articles carried by the conveyor through the tanks. In FIG. 1 the conveyor is represented as a conductive belt disposed in any manner well known to the art for movement in a path through the electrolyte of each of the tanks. The conveyor belt is usually of closed or endless loop configuration, articles to be processed being supplied to the conveyor prior to movement into the first of a succession of tanks, the hard coated articles being removed from the conveyor after leaving the last of the tanks. The apparatus described thus far is of well known construction and in particular implementations can take a wide variety of forms to suit specific performance requirements.

According to the invention, each of tanks 10, 12 and 14 is electrically isolated from ground such as by electrically insulative supports 32 which maintain the tanks above a mounting surface. Each of the tanks is connected to the negative terminal of an associated power source. In the illustrated embodiment the power source is represented by power supplies 34, 36 and 38, with tanks 10, 12 and 14 being respectively connected to the negative terminals of respective supplies 34, 36 and 38. The positive terminals of supplies 34, 36 and 38 are connected to ground. The conveyor 28 is also connected to ground. Thus, a positive electrical ground of the system is provided by the conveyor while the electrolyte and tanks are at negative potentials with respect to the grounded conveyor. Articles carried by the conveyor are at a positive potential with respect to the relative negative tank potential, the articles serving as the anode in each of the tanks.

The cooling system is insulated from ground and from the electrolyte of the tanks to maintain electrical isolation of the electrolyte and tanks. The cooling coils 18, 20 and 22 can be of electrically insulative material such as Teflon, or the piping or sections thereof can be electrically insulative. In the event that a coolant is employed which is electrically conductive, the piping which interconnects the successive tanks is of sufficient length and/or cross section to provide an intended electrical resistance path between tanks of magnitude to prevent excess current leakage.

Step continuous anodizing is readily provided by the invention since the tanks can easily be connected to different potentials with respect to the grounded conveyor. A lower potential can be applied to the initial tank 10 of a succession of tanks, such lower potential being of magnitude at which no burning of the articles entering the tank can occur. The potentials provided to the succeeding tanks, such as tanks 12 and 14 of FIG. 1, are of increased magnitude to provide the requisite hard anodized coating. Since the conveyor 28 is grounded, the shock hazard is practically eliminated and the present system provides no danger to personnel who may touch the conveyor and articles thereon during processing. In a continuous process where different articles are being coated to different thicknesses articles are removed at different times without turning off the operating voltage. Such handling of articles in conventional systems presents a major shock hazard, whereas the shock hazard is practically eliminated in the present system by the use of a grounded conveyor which is the most accessible portion of the system. The tanks are usually shielded within insulated housings 40 to prevent easy access thereto. Personnel cannot, therefore, easily come in contact with the conductive tanks themselves which can be at relatively high potentials with respect to the grounded conveyor.

Figure 2:
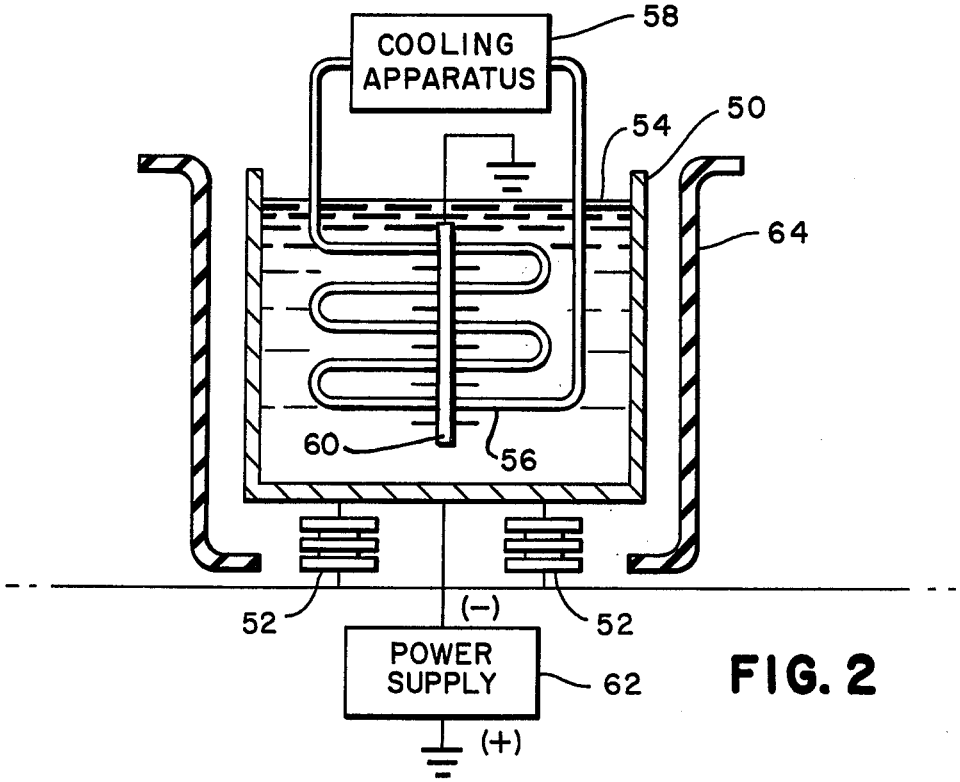
FIG. 2 is a diagramatic representation of a batch (static) type hard anodizing system according to the invention.

The invention can also be employed for batch (static) anodizing, a typical implementation being shown in FIG. 2. A conductive tank 50 is electrically isolated from ground by electrically insulative supports 52 and contains a strong electrolyte 54 of suitable composition. A cooling coil 56 is coupled to cooling apparatus 58 and, as described above, is operative to maintain the electrolyte at an intended low operating temperature. A conductive support rack 60 is disposable in the electrolyte for immersion of articles to be anodized. The support rack 60 is connected to electrical ground in order to couple the articles carried by rack 60 to electrical ground. A power supply 62 has its negative terminal connected to tank 50 and its positive terminal connected to ground. An electrically insulated enclosure 64 can be provided around tank 50 to prevent easy access to the conductive tank by personnel. As in the embodiment described above, the tank, the electrolyte contained therein and the cooling system are isolated from electrical ground. The tank is connected to the negative terminal of the power supply while the articles to be anodized are electrically grounded and such articles are, therefore, at a positive potential with respect to the relative negative tank potential.

It will be appreciated that the invention can be implemented by apparatus of many different configurations in accordance with particular operating requirements. Accordingly, it is not intended to limit the invention by what has been particularly shown and described except as indicated in the appended claims.

What is claimed is:

1. For use in a hard anodizing system producing hard porous oxide films on aluminum and aluminum alloys, a method for continuous hard anodizing comprising the steps of:

providing a strong electrolyte in each of a plurality of electrically conductive tanks;

providing cooling means in the electrolyte of each of said tanks for maintaining said electrolyte at a predetermined low operating temperature;

disposing a conductive conveyor in the electrolyte of said plurality of tanks for movement of articles supported on the conveyor sequentially through the electrolyte of each of said tanks;

electrically isolating said pluraity of tanks, electrolyte and cooling means from electrical ground;

grounding the positive terminal of a power source which includes a power supply for each of said tanks, each power supply providing a different potential;

connecting said conductive conveyor and articles supported thereon to electrical ground; and connecting each of said tanks to the negative terminal of a respective one of said power supplies.

2. The method of claim 1 further including the step of providing a predetermined electrical resistance path in the cooling means between said plurality of tanks to prevent excess current leakage.

3. The method of claim 1 wherein said isolating step includes insulating each of said plurality of tanks from electrical ground and insulating said cooling means from electrical ground and from the electrolyte in said tanks.

4. The method of claim 1 wherein said last connecting step includes connecting the first tank in which articles are immersed to the negative terminal of the power supply of lowest potential, and connecting each succeeding tank to the negative terminal of a respective power supply of successively higher potential.

5. The method of claim 1 wherein said disposing step includes the continuous movement of said conductive conveyor and articles supported thereon sequentially through the electrolyte of each of said tanks.

6. For use in a hard anodizing system producing hard porous oxide films on aluminum and aluminum alloys, a method for continuous hard anodizing comprising the steps of:

providing a strong electrolyte in each of a plurality of tanks;

providing cooling means in the electrolyte of each of said tanks for maintaining said electrolyte at a predetermined low operating temperature;

disposing a conductive conveyor in the electrolyte of said plurality of tanks for movement of articles supported on the conveyor sequentially through the electrolyte of each of said tanks;

electrically isolating said plurality of tanks, electrolyte and cooling means from electrical ground;

grounding the positive terminal of a power source which includes a power supply for each of said tanks, each power supply providing a different potential;

connecting said conductive conveyor and articles supported thereon to electrical ground; and connecting the cathode of each of said tanks to a negative terminal of a respective one of said power supplies.

* * * * *